US005593289A

United States Patent [19]

Tarpley

[11] Patent Number: 5,593,289

[45] Date of Patent: Jan. 14, 1997

[54] STANDING VALVE ASSEMBLY FOR SUCKER ROD OPERATED SUBSURFACE PUMPS

[76] Inventor: Leon Tarpley, 405 22nd St., Crane, Tex. 79731

[21] Appl. No.: 529,626

[22] Filed: Sep. 15, 1995

Related U.S. Application Data

[63] Continuation of Ser. No. 318,077, Oct. 5, 1994, Pat. No. 5,472,326, which is a continuation of Ser. No. 40,356, Mar. 30, 1993, abandoned.

[51] Int. Cl.[6] ..... F04B 53/10; F04B 53/22

[52] U.S. Cl. ..... 417/454; 417/569; 137/533.11

[58] Field of Search ..... 417/567, 569, 417/570, 555.1, 555.2, 454; 137/533.11, 533.15

[56] References Cited

U.S. PATENT DOCUMENTS

| | | | |
|---|---|---|---|
| 1,063,669 | 6/1913 | Erb | 417/569 |
| 1,523,575 | 1/1925 | Beloit | 137/533.15 |
| 2,682,281 | 6/1954 | Ecker | 137/533.15 |
| 3,684,410 | 8/1972 | Fitzgerald et al. | 417/554 |
| 4,880,366 | 11/1989 | Stinson | 417/555.1 |

*Primary Examiner*—Timothy Thorpe
*Assistant Examiner*—Roland G. McAndrews, Jr.
*Attorney, Agent, or Firm*—Milburn & Peterson, P.C.

[57] ABSTRACT

This invention relates to an improvement in plunger valve assemblies for reciprocating sucker rod operated subsurface pumps and specifically as to the traveling valves and standing valves. The traveling valve includes a valve body having an inwardly-directed lip at the bottom with the valve seat, ball and cage inserted from the top of the valve body. Further the standing valve has a closed cage formed in the upper portion thereof which is threaded into the bottom of the pump barrel, thus placing the closed cage of the standing valve and the traveling valve in closer proximity at the bottom of the downstroke than prior such pumps.

4 Claims, 2 Drawing Sheets

STANDING VALVE ASSEMBLY FOR SUCKER ROD OPERATED SUBSURFACE PUMPS

This is a continuation of application Ser. No. 08/318,077 filed Oct. 5, 1994, now U.S. Pat. No. 5,472,326, which is a continuation of prior application Ser. No. 08/040,356 filed Mar. 30, 1993 which was abandoned Jan. 12, 1995.

BACKGROUND OF THE INVENTION

1. Field of the Invention

This invention relates in general to pumps and, more particularly, to an improved fluid pump for producing oil-bearing formations, and specifically sucker rod-operated fluid pump for oil wells.

2. Description of Prior Art

A conventional oil well includes a cased well bore with one or more strings of tubing extending downwardly through the casing into the oil or other petroleum fluid contained in the subsurface mineral formation to be produced. The casing is perforated at the level of the production zone to permit fluid flow from the formation into the casing, and the lower end of the tubing string is generally open to provide entry for the fluid in the tubing.

One type of pump conventionally employed in structures of the type described is wedged into an internal constriction or seating nipple formed internal of the tubing below the fluid level. A metallic enlargement on the external body of the pump prevents it from traveling below the seating nipple and resilient seal rings on the body of the pump housing act to form a leak-proof seal between the seating nipple and pump. The pump is generally driven by a mechanical linkage of metal rods, referred to in the trade as sucker rods which extend from the pump to the well surface. The sucker rod linkage is powered in a reciprocating motion by a conventional mechanical apparatus usually called a pumping unit located at the well surface.

The conventional pump itself generally includes a housing through which a piston is reciprocated by the sucker rod linkage. In its simplest form, the conventional pump of the type described often includes a number of ball and seat valves with one such valve associated with the piston or plunger (traveling valve) and another (standing valve) at the inlet port of the housing or barrel of the pump. On the upstroke of the plunger, the ball in the inlet port valve or standing valve is drawn away from its seat and the ball of the outlet port valve or traveling valve is forced over its seat to draw fluid from below the seating nipple and into the housing. On the piston downstroke, the ball in the standing valve is forced onto its seat and the ball in the traveling valve moves away from its seat to allow the plunger to move downwardly through the fluid contained in the housing. On the subsequent upstroke, the closing of the traveling valve forces the fluid above the plunger out of the housing through the outlet ports and into the tubing above the seating nipple and simultaneously fills the housing below the plunger with fluid. Repetition of this cycle eventually fills the tubing string and causes the fluid to flow to the surface.

Ball valve pumps are also relatively limited in theoretical efficiency and cycling rate due to their inherent principle of operation. Any increase in the amount of fluid which can be produced by such a pump usually involves an increase in the driving power and pump dimensions and includes a corresponding decrease in efficiency. Moreover, the valve closure time required for the ball and seat type valves restricts the speed of the pumping cycle and thereby further limits the maximum product on rate of pumps employing these valves.

In operation of a sucker rod pump, the plunger in the barrel is lifting the entire column of oil above the plunger on the upstroke. Thus, the load on the plunger is equal to the weight of the column of oil having a cross-sectional area of the pump plunger. The cross-sectional area of the pump plunger times the depth of the oil well equals the volume of oil being lifted.

The efficiency and effectiveness of the pump depends upon a very close fit between the exterior plunger pump surface and the barrel interior cylindrical surface. When fluid leakage occurs between these surfaces, efficiency of the pump is reduced and if substantial fluid flow occurs between the exterior plunger surface and the interior barrel, the pump can become totally defective. The problem of pumping crude oil is that in some locations substantial components of sand or other abrasives are entrained within the crude oil fluid. Most oil producing formations are of relatively high porosity and are formed of compacted sand granules, and some of the sand granules become dislodged from the formation as the fluid is extracted from it. Abrasives also originate from scale, mineral deposits and other sources. Since most reciprocating downhole pumps are made of metal, that is, a metal barrel and a metal plunger, there is metal to metal contact as the plunger is reciprocated within the barrel. If sand is entrained within the crude oil fluid, the abrasive effect can soon wear a pump plunger to the point where the well efficiency drops below an acceptable level. The traveling valve in most sucker rod pumps has a housing that is less than the internal diameter of the barrel and consequently permits fluids to gather around in between the traveling valve housing and the barrel exacerbating the abrasion problems.

Various arrangements of pumps have been suggested in the prior art to overcome the various problems associated with sucker rod pumps for oil wells. U.S. Pat. No. 5,141,416 to Cognevich et al describes a method of manufacturing a plunger for a downhole reciprocating oil well pump. A cylindrical material plunger has its outer surface machined and then is prepared by grit-blasting to receive a coating of ceramic and then the ceramic outer surface is ground to the proper plunger design diameter. Cognevich et al is providing a surface that is longer wearing than the original material surface of the plunger.

U.S. Pat. No. 5,009,000 to Wilmeth et al describes a method of hardening the plunger by forming a boronized case on the plunger. The plunger additionally includes circumferential grooves which tend to trap abrasive particles and help equalize hydrostatic pressure around the plunger.

U.S. Pat. No. 4,968,226 to Brewer describes a plurality of openings formed in the midportion of the pump barrel. These openings allow fluid from the tubing string to enter the intake chamber of the barrel during a portion of the upstroke permitting equilibration of the pressure differential therebetween. Further Brewer provides a traveling valve with a substantially reduced outside diameter which permits fluid around the outside diameter traveling valve cage which permits fluid around its outer surface between the pump barrel and the traveling valve cage. A plunger, sized for substantially fluid tight reciprocation relative to the barrel, is received in the barrel. The plunger has a top with an opening therein and a bottom with an opening therein, and a body. The body defines a cavity continuous with the openings in the top and bottom of the plunger. The length of the plunger is substantially less then the length of the barrel. The plunger has an end portion which, with a portion of the barrel cavity, defines a fluid intake chamber. The volume of the fluid intake chamber therefore varies with reciprocal movement of the plunger and the barrel. A valve associated with the plunger is included for permitting fluid to flow through the plunger only in an upward direction. The openings in the midportion of the barrel cooperate with the relative lengths of the barrel and the plunger to prevent fluid communication between the conduit and the fluid intake chamber during a first phase of the extension stroke and to permit communication between the conduit and the fluid intake chamber during a second phase of the extension stroke.

U.S. Pat. No. 4,662,831 to Bennett discloses a pump for lifting liquids from a well in an earth formation and concurrently fracturing the earth formation. This is accomplished using a pump of the reciprocating piston variety and providing a first valve that permits a quantity of the liquid to be gathered on the downstroke of the pump and lifted during the upstroke of the pump and a second valve that permits a portion of the formation liquids to be forced back in to the earth formation during a first portion of the downstroke of the pump and that prevents further passage of fluids back in to the formation during a second portion of the downstroke of the pump. Also, a third valve for venting formation gases from the interior of the pump near the top of the pump upstroke in order to prevent cushioning of the force of the pump downstroke due to the compressibility of such gases.

U.S. Pat. No. 3,697,199 to Spears discloses a slave valve pump. The pump employs a first piston which is directly moved by an external power source and a slave piston which is moved by the resulting pressure differentials created by the movement of the first piston. The first or lower piston is fixed to the lower end of a cylindrical rod and the upper piston has a tubular form and is adapted to slide over the rod. The axial movement of the upper piston is controlled by the resulting pressure differential crested across its length. The pressure differential acts to move the upper piston to appropriately open or close the outlet ports of the pump which in turn permits fluid to be expelled through the outlet ports and prevents return flow into the pump. On the downstroke of the lower piston, a reduced pressure is created between the slave piston and the lower piston which permits fluid flow into this low pressure area between the two pistons which the lower piston moves past inlet ports and fluid is forced through the inlet ports to the low pressure area.

The problem with the API standard pumps prevalent throughout the oil industry is that the pumps are confronted with pumping fluids and gases drawn into the barrel of the pump and whatever abrasive particles, such as quartz or sand, brought into the pump on the upstroke will be forced to move around in the barrel and around the outer surface of the traveling valve on the downstroke which causes abrasion, and in some instances the gas will collect and compress and cause gas lock to occur. Certainly hardening the plunger will assist in reducing the amount of wear on the plunger and perhaps leakage past the plunger.

The object of the present invention is to provide a pump in which the outside diameter of the traveling valve body is of comparable outside diameter as the plunger.

It is a further object of the present invention to provide an improved downhole pump in which the stationary valve is placed within the upper threaded area of the barrel cage and where the traveling valve is placed in the lowermost portion of the plunger cage, thus reducing the distance between the traveling valve and the stationary valve at the bottom of the downstroke of the plunger.

It is a further object of the present invention to provide an improved downhole pump which is of a lesser length or longer stroke by providing a stationary valve in the upper threaded area of the barrel cage and the traveling valve is placed in the lowermost portion of the portion of the closed plunger cage, thus reducing the distance between the traveling valve and the stationary valve at the bottom of the downstroke of the plunger.

SUMMARY OF THE INVENTION

The invention provides an improved reciprocating pump for production of fluids from oil and gas wells. The improvement lies in redesigning the barrel cage or the stationary valve body and the plunger cage or traveling valve body in a manner to reduce the space between the stationary valve and the traveling valve when the pump is at the end of the downstroke. In addition, the plunger cage or traveling valve body of the traveling valve may be designed to have the identical outside diameter as the plunger itself. In this fashion, the plunger and the plunger cage or traveling valve body of the traveling valve act as a unitized plunger, although it is threaded onto the plunger pin or a connector having the same outside diameter as the plunger.

The plunger cage or traveling valve body is a hollow body having an inner flange at the bottom on which the seat for the ball is positioned. The ball is then placed in the hollow body and then the ball insert or cage is placed over and surrounds the ball. The plunger cage is secured to the plunger pin with an o-ring seal.

Because the plunger cage may have the same tolerance as the plunger, there would be minimal space around the outer area of the plunger cage to permit fluid to move around between the barrel and the plunger cage. Consequently on the downstroke, the plunger cage and plunger acting as a unitized plunger purge most of the fluid and other material drawn into the barrel on the upstroke through the traveling valve.

DETAILED DESCRIPTION OF THE PREFERRED EMBODIMENT

Figure 1:
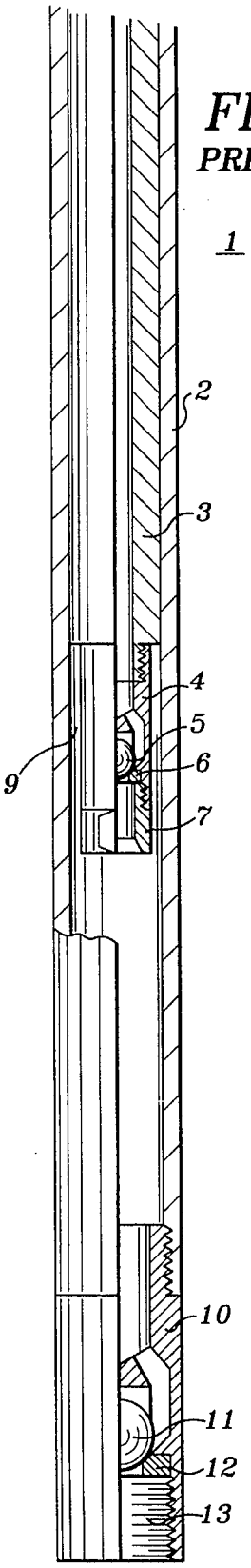
FIG. 1 PRIOR ART
FIG. 1 is a partial sectional view of a pump having a standing valve and a traveling valve typical of the prior art.

Referring now to the drawings, and in particular to FIG. 1, there is illustrated a prior art pump 1 having a pump barrel 2, a plunger 3, which operates within the pump barrel 2 by a series of rods attached to the plunger 3 which reciprocate the plunger 3 by motive power on the surface. Associated with the plunger 3 is a plunger cage 4 which, in conjunction with ball 5 and seat 6, form a valve which is referred to as a traveling valve. The plunger cage 4 is threaded into the plunger pin. Since the plunger cage 4 is of lesser diameter than the plunger 3, there is an annular space 9 created between the plunger cage 4 and the pump barrel 2 where gases can accumulate and abrasive materials drawn into the pump barrel with oil or the fluid being produced can flow. The pump 1 has a barrel cage or standing valve body 10. The standing valve is similar to the traveling valve. It is threaded into the pump barrel 2 and has a ball 11 and a seat 12 retained therein by a seat plug or retainer 13.

If the prior art pump in FIG. 1 was placed in service, then on the upstroke of plunger 3, ball 11 is lifted off its seat 12 and ball 5 remains seated, thus lifting the fluid above the plunger. Then on the downstroke, the normal operation is ball 5 would be off seat 6 and ball 11 would be on seat 12 and the fluid previously drawn into the pump barrel on the upstroke would be purged through the traveling valve and at the same time, fluid would be circulating within the annular space 9 between the plunger cage 4 and pump barrel 2. The seat plug 13 may be replaced by a holddown mandrel assembly not shown.

Figure 2:
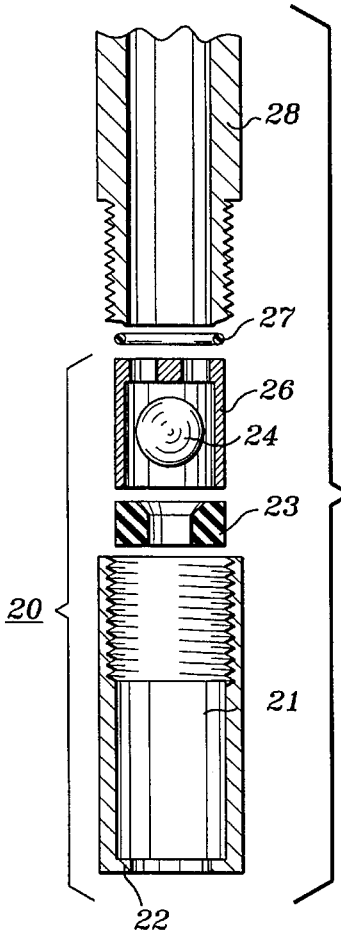
FIG. 2 is a sectional exploded view of the improved traveling valve.
Figure 3:
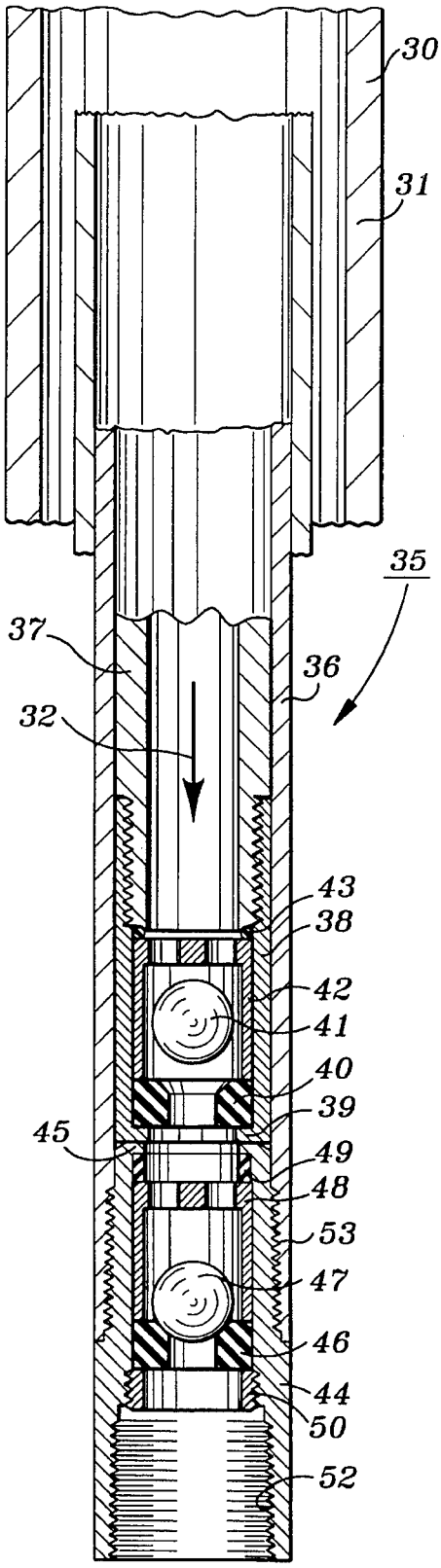
FIG. 3 is a sectional schematic representation of the improved pump on the downstroke.
Figure 4:
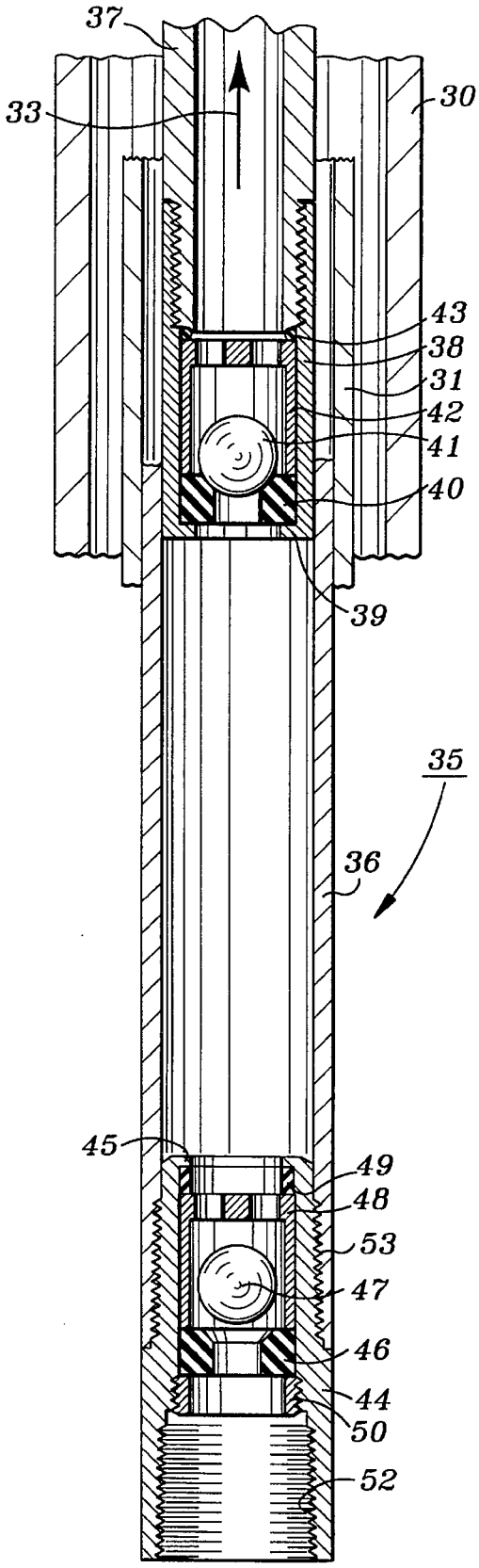
FIG. 4 is similar to FIG. 3 with the pump on the upstroke, with the traveling valve closed and the stationary valve open.

Referring now to FIGS. 2, 3 and 4, which illustrates a first embodiment of the standing valve of the present invention, and referring specifically to FIG. 2, there is shown a traveling valve 20. The traveling valve 20 has a traveling valve body 21 which at the lower end thereof has an inward circular flange 22. Valve seat 23 is placed in traveling valve body 21 resting on the circular flange 22. Ball 24 is then placed on the seat and ball insert 26 is placed around ball 24 and against seat 23. The traveling valve body 21 is threadably secured to connector 28 with an o-ring 27 to seal the traveling valve 20 to the connector 28. Connector 28 has the same outside diameter as traveling valve body 21 and would be secured to a plunger pin of a plunger with the same outside diameter. Instead of connector 28, traveling valve 20 could be threaded upon the plunger pin of the plunger having the same outside diameter.

Referring now specifically to FIGS. 3 and 4, there is illustrated schematically a sucker rod operated pump generally referred to as pump 35 positioned within tubing string 31 which is within casing 30. The pump 35 in FIG. 3 is shown on the downstroke as indicated by arrow 32 and in FIG. 4 on the upstroke as indicated by arrow 33. Reference hereafter to the parts of the traveling valve the indicia TV will be used and the standing valve the indicia SV will be used. Within the tubing 31 is pump barrel 36, housing plunger 37. Threaded on the plunger 37 is the TV body 38. The TV body 38 has a flange 39, and the TV seat 40 is positioned internal of TV body 38 on flange 39. TV ball 41 is positioned within the TV ball cage 42. The TV body 38 is threaded to the plunger 37 with an o-ring 43 positioned between the top of TV ball cage 42 and the end of plunger 37, thus forming a liquid seal between the plunger 37 and the TV body 38. The standing valve is formed by a cage bushing 44 having a retainer flange 45 at its upper end. A rubber retainer 49 is inserted in cage bushing 44 and against retainer flange 45. SV cage 48 is positioned against rubber retainer 49. The SV ball 47 is placed within SV cage 48, and SV seat 46 is seated against the lower end of SV cage 48. Seat retainer 50 is threaded into the lower end of cage bushing 44 in threads 52 and is seated against SV seat 46 to hold it in place. It should be noted that the cage bushing 44 has threads 52 such that the seat retainer 50 may be threaded up into the cage bushing 44 in such a manner that the entire standing valve is positioned in the upper threads 53 of cage bushing 44.

It will be appreciated that TV body 38 may have the same outside diameter as plunger 37 and that plunger 37 and TV body 38 act in tandem as a unitized plunger. Further in comparison with the prior art on the downstroke as seen in FIG. 3, the traveling valve and the standing valve are much closer in proximity to each other than in the prior art pump 1. It should be recognized that neither drawing is to scale. Generally, the distance between the traveling valve and the standing valve in the prior art as shown in FIG. 1 is approximately 10½ inches, whereas in the present invention the space between the traveling valve and the standing valve is ½ to ¾ inch on the pump downstroke. It should also be noted that in the traveling valve depicted in FIG. 2, the valve is assembled from the top and thus there is no retainer screwed into the bottom which could fail or become loose or corrode, such that the whole valve would fail.

The operation of the pump illustrated in FIGS. 3 and 4 follows. On the downstroke as viewed in FIG. 3, the standing valve has SV ball 47 seated on SV seat 46. Thus no fluid can go back into the well bore or reservoir. At the same time TV ball 41 is off of TV seat 40 and hence the fluid brought in on the upstroke between the bottom of the traveling valve and the pump barrel 36 is forced to go through the traveling valve with minimum swirling around the outer surface of TV body 38. TV body 38 may be made of the same material as plunger 37 and acts in tandem with plunger 37 as a unitized plunger.

On the upstroke of the plunger as viewed in FIG. 4, the TV ball is seated on TV seat 40 and the SV ball 47 is off of SV seat 46. Thus, fluid is drawn through the standing valve into the barrel 36 below the traveling valve.

It will be understood with the pumping operation described in connection with FIGS. 3 and 4, that on the upstroke most of the entrained gas or abrasives or other foreign material drawn into the barrel 36 of the pump 35 will be purged through the traveling valve on the downstroke and that there is minimal clearance between the traveling valve 38 and the barrel 36 of pump 35 to permit abrasive material around the TV body 38 or permit gas to accumulate between the TV body 38 and the barrel 36 of pump 35.

Figure 5:
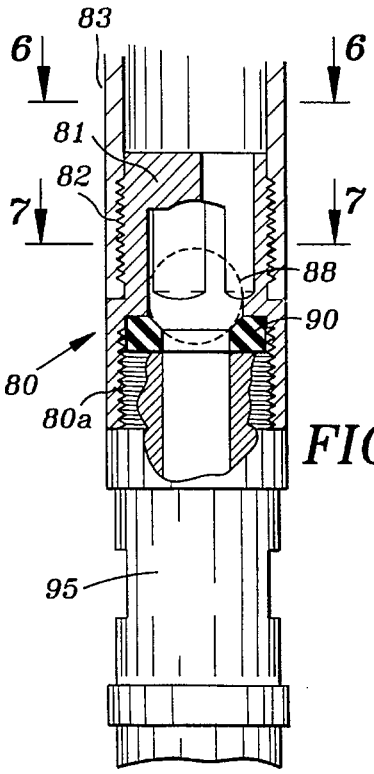
FIG. 5 is a sectional schematic representation of the cage standing valve.
Figure 6:
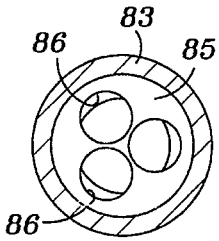
FIG. 6 is a cross-sectional view of the closed cage depicted in FIG. 5 taken along lines 6—6.
Figure 7:
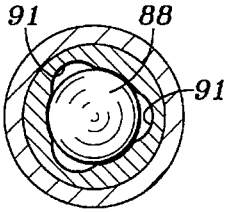
FIG. 7 is a cross-sectional view of the standing valve taken along lines 7—7 of FIG. 5 with a holddown securing the seat.

Referring now to FIGS. 5, 6, and 7, a second embodiment of the invention, it will be observed that the standing valve 80 includes a valve body **80*a* having cage 81 formed internally as an integral part of standing valve 80. The external diameter of valve body 80*a* has threads 82. Standing valve 80 is secured to barrel 83 of a pump (not shown) similar to pump 35 in FIG. 4 by external threads 82 of valve body 80*a*. The cage 81 has an end 85 with three apertures 86 which permit passage of fluid through standing valve 80 when ball 88 is off of valve seat 90. Apertures 86 ream a vertical portion of the internal wall of cage 81 forming a fluid passage 91 around ball 88. It will be understood that valve seat 90 is held in place by a holddown 95 or the like which could be the mechanical bottom lock holddown, mechanical top lock holddown or cup-like holddown as described in the Trico Industries, Inc. 1992–93, Subsurface Rod Pump Catalog at page 3328 (corporate offices address: 3040 East Flauson Avenue, P.O. Box 2909, Huntington Park, Calif. 90255). The cup-type is illustrated as holddown 95 in FIG. 5. These are of conventional construction and well known to the industry. Consequently, this arrangement avoids the necessity of a seat retainer similar to the seat retainer 50 in FIG. 4. It will be noted that cage 81 of standing valve 80 is threaded into pump barrel 83 and is substantially within threads 82**.

Also it will be appreciated that the close proximity between the standing valve and the traveling valve at the bottom of the downstroke is such that either the pump itself may be shorter for the same stroke of the plunger or the stroke of the plunger may be increased by the decrease in distance between the traveling valve and the standing valve on the downstroke.

The preferred embodiment of the present invention has been shown and described and it is obvious that changes and modifications can be made therein without departing from the true scope and spirit of the invention and it is intended that the invention is only limited by the claims that follow.

What is claimed is:

1. In a subsurface rod pump having a barrel and a plunger for pumping fluid from an oil and gas reservoir, the improvement comprising a standing valve assembly which includes:

a cylindrical valve body having a lower section, said lower section having a counterbore with internal threads, and an upper section having a reduced external diameter and externally threaded for attachment within the barrel below the plunger, said upper section with an upset end forming a cage integral with and completely within said upper section reduced external diameter of the cylindrical valve body;

a valve ball positioned within said cage;

a valve seat abutting said cage; and a holddown threaded into the lower section of said valve body for retaining said valve seat in said valve body.

2. The subsurface rod pump of claim 1 wherein the holddown is a mechanical bottom lock holddown.

3. The subsurface rod pump of claim 1 wherein the holddown is a mechanical top lock holddown.

4. The subsurface rod pump of claim 1 wherein the holddown is a mechanical cup-type holddown.

* * * * *